US005683753A

United States Patent [19]

Yamaguchi et al.

[11] Patent Number: 5,683,753

[45] Date of Patent: Nov. 4, 1997

[54] METHOD OF PAINTING BUILDING BOARDS

[75] Inventors: Takahiro Yamaguchi, Ichinomiya; Mamoru Murase, Mie, both of Japan

[73] Assignee: Nichiha Corporation, Nagoya, Japan

[21] Appl. No.: 632,131

[22] Filed: Apr. 15, 1996

[30] Foreign Application Priority Data

May 1, 1995 [JP] Japan ..... 7-106785

[51] Int. Cl.[6] ..... B05D 1/02; B05B 15/02; B05B 7/02

[52] U.S. Cl. ..... 427/424; 427/421; 118/302

[58] Field of Search ..... 427/421, 424; 118/302

[56] References Cited

U.S. PATENT DOCUMENTS

| | | | |
|---|---|---|---|
| 3,477,870 | 11/1969 | Boretti et al. | 427/424 |
| 4,232,055 | 11/1980 | Shaffer | 427/33 |
| 4,259,372 | 3/1981 | Eddy | 118/302 |
| 4,469,043 | 9/1984 | Kohler et al. | 118/302 |
| 5,240,502 | 8/1993 | Castaldo et al. | 118/302 |

FOREIGN PATENT DOCUMENTS 6-155729 6/1994 Japan .

*Primary Examiner*—Shrive Beck
*Assistant Examiner*—Michael Barr
*Attorney, Agent, or Firm*—Foley & Lardner

[57] ABSTRACT

A method of painting building boards includes the steps of conveying each of a plurality of building boards on a conveyor in turn to a painting position, injecting paint from a plurality of injection nozzles arranged over the painting position when the building board passes the painting position, so that the board is painted with the injected paint, and cleaning each injection nozzle by cleaning means timely during interruption of an injecting operation of each injection nozzle so that the paint adherent to the lower end of each injection nozzle and around each injection nozzle is removed.

12 Claims, 2 Drawing Sheets

METHOD OF PAINTING BUILDING BOARDS

BACKGROUND OF THE INVENTION

1. Field of the Invention

This invention relates to a method of painting architectural or building boards or planks wherein paint is injected from injection nozzles to be applied to a surface of the building board.

2. Description of the Prior Art

Painting methods have recently been proposed wherein paint is applied to a surface of a building board or plank so that the board is decorated with a novel or up-to-date pattern or figure. An ink jet type painting machine is used in the methods. Paint is injected from injection nozzles of the painting machine onto the surface of the building board. Publication No. 6-155729 (1994) of a Japanese unexamined patent application discloses one of such painting methods. In the disclosed method, a painting head is disposed over a building board which is conveyed along a conveyor. Paint stored in a paint tank is force fed by a pump to the painting head. The painting head comprises electromagnetic valves which are turned on and off so that the paint is intermittently injected from injection nozzles to be applied to the surface of the building board, whereby the board is decorated with a pattern or figure.

In the above-described method, however, the paint is intermittently injected from the injection nozzles. Consequently, drops of paint remains on lower ends of some or all of the injection nozzles every time the injection of paint is interrupted. Furthermore, the injected paint splashes during the painting to adhere to portions of the painting head around some or all of the injection nozzle. These drawbacks are eminent when a large quantity of paint is used. The paint adherent to the lower end of each injection nozzle and the painting head portion around each injection nozzle falls in drops onto the painted building board. Consequently, the quality of the painted building board is lowered and accordingly, the yield of the finished boards is reduced.

SUMMARY OF THE INVENTION

Therefore, an object of the present invention is to provide a method of painting building boards wherein the To achieve the object, the present invention provides a method of painting building boards comprising the steps of conveying a plurality of building boards along conveyor rollers in turn to a painting position, each building board having a forward end and a rear end, initiating injection of paint from a plurality of injection nozzles positioned in a nozzle assembly disposed over the painting position when the forward end of each building board reaches the painting position, whereby the paint is applied to a surface of each building board, interrupting the injection of paint when the rear end of each building board passes the painting position, vertically lifting a cleaning means toward the injection nozzles to a cleaning position while each injection nozzle is interrupted, cleaning a lower end of each injection nozzle and portions of said nozzle assembly around said injection nozzles by the cleaning means during interruption of an injecting operation of each injection nozzle so that the paint adherent to the lower end of each injection nozzle and the portions of said nozzle assembly around said injection nozzles is removed, and lowering the cleaning means to a withdrawal position below the conveyor rollers before the forward end of the succeeding building board reaches the painting position, the cleaning means being withdrawn below the conveyor rollers at least during the injection of paint from each injection nozzle so as not to obstruct conveyance of the building boards.

According to the above-described method, the cleaning means removes the paint adherent to the lower ends of the injection nozzles and that splashed onto the portions around the injection nozzles are removed, thereby preventing the paint from falling in drops onto the board. Subsequently, the paint is injected from the injection nozzles when the board passes below the injection nozzles, so that the injected paint is applied to the surface of the board. Consequently, a high quality of paint film can be formed on the board without paint drops fallen thereon.

The injecting operation of each injection nozzle may be interrupted so that each injection nozzle is cleaned by the cleaning means every time one board is completely painted. Thus, since the painting for every one of the boards and the cleaning of the injection nozzles are alternately carried nozzles in drops onto the board.

An actuator may be provided for moving the cleaning means from a withdrawal position away from the injection nozzles to a cleaning position. Consequently, the cleaning operation by the cleaning means can be automatized. When the actuator comprises an air cylinder, the cleaning operation is softly performed such that the injection nozzles can be prevented from being damaged during the cleaning. Additionally, when the cleaning means is formed of a water adsorptive material, the paint adherent to the injection nozzles can be wiped away with high efficiency.

BRIEF DESCRIPTION OF THE DRAWINGS

Other objects, features and advantages of the present invention will become clear upon reviewing the following description of preferred embodiments thereof, made with reference to the accompanying drawings, in which.

DETAILED DESCRIPTION OF THE PREFERRED EMBODIMENT

Figure 2:
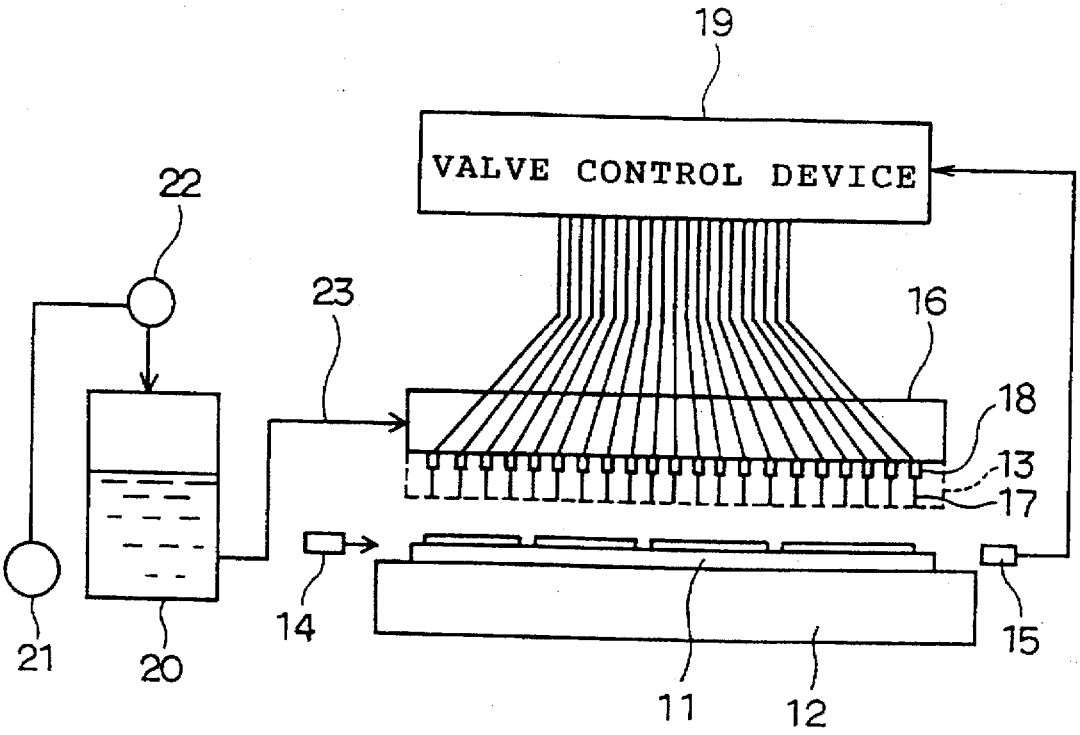
FIG. 2 is a schematic front view of a painting machine carrying out the method of the embodiment in accordance with the present invention.
Figure 3:
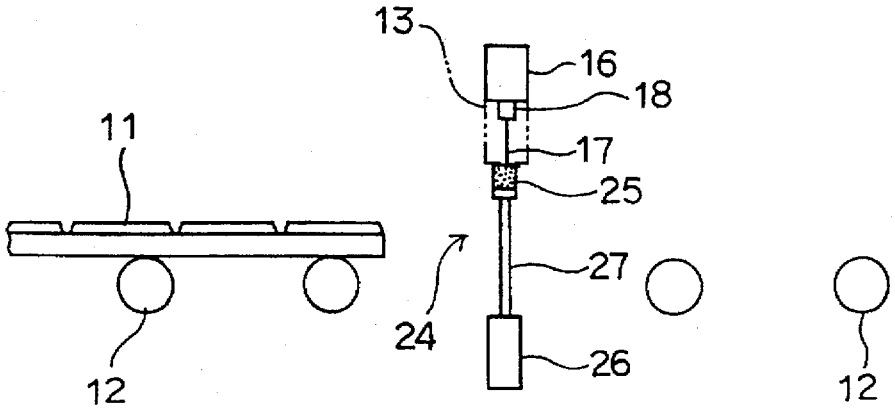
FIG. 3 is a schematic side view of the painting machine.

One embodiment of the present invention will be described with reference to the accompanying drawings. Referring to FIGS. 2 and 3, a painting machine carrying out the method of the present invention is shown. Building boards 11 to be painted are conveyed along a roller conveyor 12. A light emitter 14 and a light detector 15 both constituting a photoelectric sensor are disposed at both sides of the roller conveyor 12 respectively. The photoelectric sensor is provided for detecting the presence or absence of the board 11 passing a predetermined position immediately prior to a painting position where a painting operation is initiated.

A painting head 16 is disposed over the painting position. The painting head 16 comprises a nozzle assembly 13 attached to the underside thereof. The nozzle assembly 13 includes a number of injection nozzles 17 which are mounted on valves 18 so as to be directed downwardly, respectively, which valves 18 being further mounted on the nozzle assembly 13. The injection nozzles 17 are aligned in a direction of the width of the assembly or in a direction intersecting the direction in which the boards 11 are conveyed, so that the whole width of each board conveyed can be covered. An arrangement pitch of the nozzles 17 is set in a range of 0.5 to 3.0 mm, for example. Furthermore, the diameter of each nozzle 17 when the same is opened is set in a range of 200 to 1,000 μm, for example.

A valve control device 19 is provided for controlling the valves 18 of the respective injection nozzles 17. Based on a signal from the light detector 15, the valve control device 19 determines whether the board 11 has passed the above-mentioned predetermined position immediately prior to the painting position or not. Immediately after the board 11 has passed the predetermined position, the valves 18 are operated to be opened and closed so that paint (ink) is injected from each injection nozzle 17. The injected paint is applied to an irregular surface of the board 11 conveyed to the painting position directly below the injection nozzles 17, whereupon the surface of the board 11 is decorated with a pattern or figure.

The paint supplied to the painting head 16 is stored in a closed paint tank 20. A compressor 21 supplies low pressurized air through a regulator 22 into the paint tank 20 so that the paint in the tank 20 is force fed through a paint piping 23 to the painting head 16 with the pressure in the paint tank 20 being maintained at a constant value. The paint is injected from the injection nozzles 17 when the respective valves 18 thereof are opened. Particularly in the embodiment, the air pressure applied to the paint tank 20 is rendered low so that the paint is injected from each injection nozzle 17 in a uniflux condition, that is, in an unatomized condition. Consequently, a novel pattern or figure can be stably formed on the surface of the board.

Figure 1A:
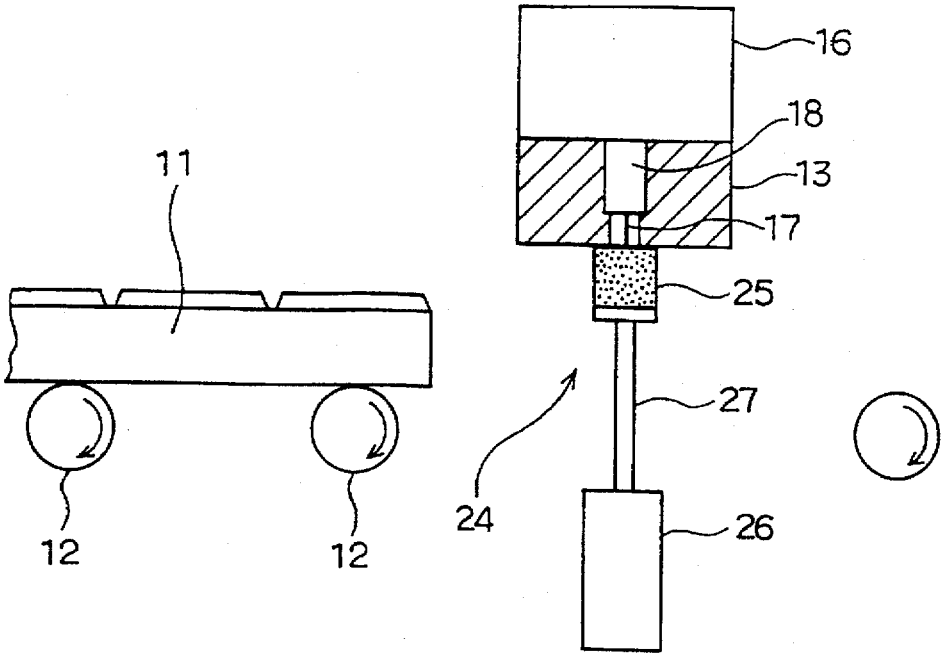
FIGS. 1A and 1B are side views of a cleaning mechanism in one embodiment of the present invention both during the paint wiping operation and during the painting operation respectively.
Figure 1B:
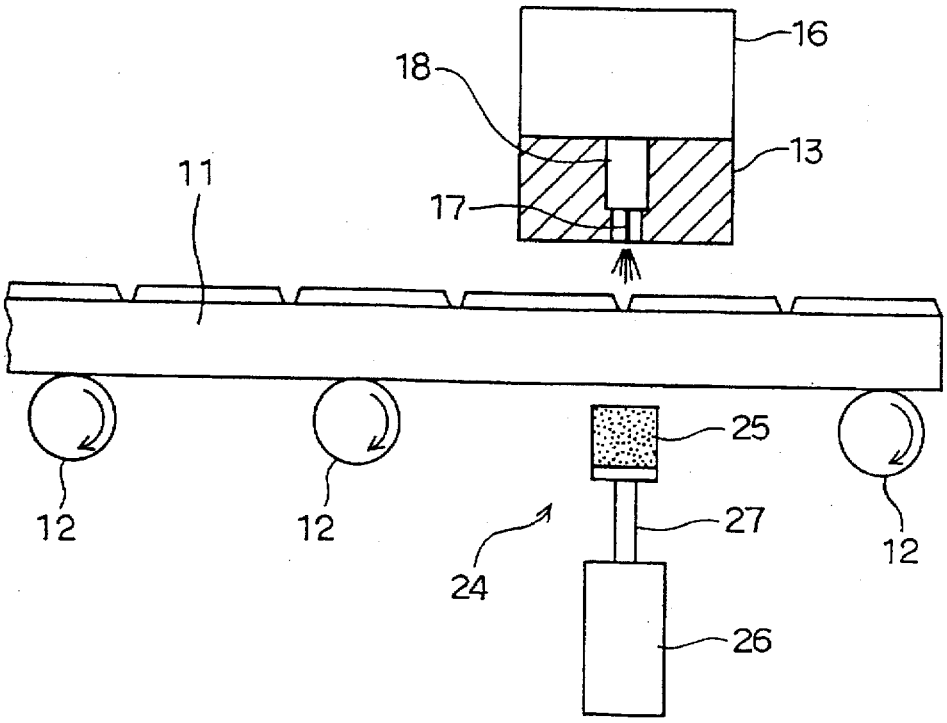

Referring now to FIGS. 1A and 1B, a cleaning mechanism 24 is shown. The cleaning mechanism 24 is provided for wiping away the paint adherent to the lower ends of the respective injection nozzle 17 and to portions of the nozzle assembly 13 around the nozzles 17. An actuator or air cylinder 26 is fixed to a suitable member (not shown) to be positioned directly below the injection nozzles 17 and to be directed upwardly. A water absorber 25 serving as cleaning means is fixed to an upper end of a rod 27 of the air cylinder 26 so as to be parallel to the row of injection nozzles 17. The water absorber 25 is formed of a water absorptive material such as fiber, felt, unwoven cloth, or sponge so that the wiping efficiency can be enhanced. The water absorber 25 has a length set to cover an overall length of the nozzle assembly 13.

The water absorber 25 is raised to a cleaning position when the rod 27 of the air cylinder 26 is extended to an uppermost position, as is shown in FIG. 1A. Upon raise to the cleaning position, the water absorber 25 comes into contact with the lower end of the injection nozzle 17 and with the portion of the nozzle assembly 13 around the injection nozzle 17, thereby wiping away the paint adherent to these portions. The water absorber 25 is caused to depart from the injection nozzle 17 to be lowered to a withdrawal position below the building board 11 when the rod 27 of the air cylinder 26 is lowered to a lowermost position, as is shown in FIG. 1B.

During conveyance of the boards 11, the valve control device 19 is adapted to control the valves on the basis of the signal input from the light detector 15 so that the paint is injected only when the board 11 passes below the injection nozzles 17. Accordingly, the injection of paint from the nozzles 17 is interrupted while the water absorber 25 is being moved to the cleaning position, as shown in FIG. 1A.

The injection nozzles 17 are interrupted every time one building board 11 is completely painted, so that the rod 27 of the air cylinder 26 is raised to raise the water absorber 25 to the cleaning position where the same wipes away the paint adherent to the lower end of the injection nozzle 17 and with the portion of the nozzle assembly 13 around the injection nozzle 17, as shown in FIG. 1A. Thereafter, the rod 27 of the air cylinder 26 is lowered before the subsequent board 11 reaches the painting position, so that the water absorber 25 is withdrawn downwardly to the withdrawal position and then, the subsequent board 11 is painted, as shown in FIG. IB.

Thus, the water absorber 25 repeatedly cleans the injection nozzles 17 every time one board 11 is completely painted. Consequently, since the paint can be reliably prevented from falling in drops from the injection nozzles 17, a high quality of painting can be applied to the surface of the building board without paint drops fallen thereon, and defective in the painting can be improved as compared in the prior art.

The injection nozzles 17 are cleaned every time one building board 11 is completely painted in the foregoing embodiment. The nozzles 17 may be cleaned every time a plurality of boards 11 are completely painted, instead. What is essential is that the nozzles 17 are timely cleaned during interruption of the paint injecting operation thereof.

The water absorber 25 is fixed to the upper end of the rod 27 of the air cylinder 26 as the means for cleaning the injection nozzles 17 in the foregoing embodiment. A water absorptive roll may be rotatably mounted on the upper end of the rod 27, instead. In this regard, the water absorptive roll is moved to the cleaning position and is then rotated every time the same comes into contact with the injection nozzle 17 so that a wiping surface of the roll is changed from one to another. Consequently, the wiping efficiency can be improved. Furthermore, since the roll is rotated, the wiping operation can be performed smoothly. Moreover, since the overall circumferential surface of the roll can be used as a wiping surface, the area of the wiping surface can be increased. Consequently, since a service period of the water absorptive roll can be improved, the number of times of replacement of the rolls can be reduced, and maintainability can be improved.

The cleaning means may spray the injection nozzle 17 with compressed air supplied from a compressor or the like to blow off the paint adherent thereto. Furthermore, one end of a hose connected to a vacuum pump or the like may be positioned near the injection nozzles 17 so that superfluous paint is sucked.

The air cylinder 26 is used as the actuator moving the water absorber 25 between the withdrawal and cleaning positions in the foregoing embodiment. Consequently, the cleaning operation is softly performed such that the injection nozzles 17 can be prevented from being damaged during the cleaning.

However, the actuator should not be limited to the air cylinder 26. Another actuator such an electric motor may be used for moving the water absorber 25, instead. Furthermore, the self-weight of a balance weight or an elastic force of an elastic member such as a spring may be utilized for movement of the water absorber 25. In this case, a support arm supporting the water absorber is pushed down by the building board 11 which is being conveyed against the balance weight or the elastic member, so that the water absorber is moved to the withdrawal position and then, the absorber is moved to the cleaning position by the balance weight or elastic member after the board 11 has passed the painting position. Consequently, since the water absorber is moved by the balance weight or elastic member, electric power can be saved.

The foregoing description and drawings are merely illustrative of the principles of the present invention and are not to be construed in a limiting sense. Various changes and modifications will become apparent to those of ordinary skill in the art. All such changes and modifications are seen to fall within the true spirit and scope of the invention as defined by the appended claims.

What is claimed is:

1. A method of painting building boards comprising the steps of:

conveying a plurality of building boards along conveyor rollers in turn to a painting position, each building board having a forward end and a rear end;

initiating injection of paint from a plurality of injection nozzles positioned in a nozzle assembly disposed over the painting position when the forward end of each building board reaches the painting position, whereby the paint is applied to a surface of each board;

interrupting the injection of paint when the rear end of each building board passes the painting position;

vertically lifting a cleaning means between the conveyor rollers and toward the injection nozzles to a cleaning position while each injection nozzle is interrupted;

cleaning a lower end of each injection nozzle and portions of said nozzle assembly around said injection nozzles by the cleaning means during interruption of an injecting operation of each injection nozzle so that the paint adherent to the lower end of each injection nozzle and the portions of said nozzle assembly around said injection nozzles is removed; and lowering the cleaning means to a withdrawal position below the conveyor rollers before the forward end of the succeeding building board reaches the painting position, the cleaning means being withdrawn below the conveyor rollers at least during the injection of paint from each injection nozzle so as not to obstruct conveyance of the building boards.

2. A method according to claim 1, wherein the injecting operation of each injection nozzle is interrupted so that the lower end of each injection nozzle and the lower end of said nozzle assembly are cleaned by the cleaning means every time one board is completely painted.

3. A method according to claim 2, wherein an actuator is provided for moving the cleaning means from said withdrawal position away from the injection nozzles to said cleaning position.

4. A method according to claim 3, wherein the actuator comprises an air cylinder.

5. A method according claim 1, wherein the cleaning means is formed of a water adsorptive material.

6. A method according to claim 2, wherein the cleaning means is formed of a water adsorptive material.

7. A method according to claim 3, wherein the cleaning means is formed of a water adsorptive material.

8. A method according to claim 4, wherein the cleaning means is formed of a water adsorptive material.

9. A method according to claim 1, wherein the paint is stored in a closed paint tank and compressed air is supplied by a compressor through a regulator into the paint tank so that the paint in the paint tank is fed to each injection nozzle with pressure in the paint tank being maintained at a constant value.

10. A method of painting building boards comprising the steps of:

conveying a plurality of building boards along conveyor rollers in turn to a painting position, each building board having a forward end and a rear end;

initiating injection of paint from a plurality of injection nozzles positioned in a nozzle assembly disposed over the painting position when the forward end of each building board reaches the painting position, whereby the paint is applied to a surface of each board;

interrupting the injection of paint when the rear end of each building board passes the painting position;

vertically lifting a cleaning means toward the injection nozzles to a cleaning position while each injection nozzle is interrupted;

cleaning a lower end of each injection nozzle and portions of said nozzle assembly around said injection nozzles by the cleaning means during interruption of an injecting operation of each injection nozzle so that the paint adherent to the lower end of each injection nozzle and the portions of said nozzle assembly around said injection nozzles is removed; and lowering the cleaning means to a withdrawal position below the painting position before the forward end of the succeeding building board reaches the painting position, the cleaning means being withdrawn below the painting position at least during the injection of paint from each injection nozzle so as not to obstruct conveyance of the building boards, wherein the cleaning means comprises a rotatable water absorptive roll.

11. A method of painting building boards comprising the steps of:

conveying a plurality of building boards along conveyor rollers in turn to a painting position, each building board having a forward end and a rear end;

initiating injection of paint from a plurality of injection nozzles positioned in a nozzle assembly disposed over the painting position when the forward end of each building board reaches the painting position, whereby the paint is applied to a surface of each board;

interrupting the injection of paint when the rear end of each building board passes the painting position;

vertically lifting a cleaning means between the conveyors or rollers and toward the injection nozzles to a cleaning position while each injection nozzle is interrupted;

cleaning a lower end of each injection nozzle and portions of said nozzle assembly around said injection nozzles by the cleaning means during interruption of an injecting operation of each injection nozzle so that the paint adherent to the lower end of each injection nozzle and the portions of said nozzle assembly around said injection nozzles is removed; and lowering the cleaning means to a withdrawal position below the painting position before the forward end of the succeeding building board reaches the painting position, the cleaning means being withdrawn below the painting position at least during the injection of paint from each injection nozzle so as not to obstruct conveyance of the building boards, wherein the injecting operation of each injection nozzle is interrupted so that the lower end of each injection nozzle and the lower end of said nozzle assembly are cleaned by the cleaning means every time one board is completely painted, and wherein the cleaning means is supported by a support arm, wherein the support arm is urged by a balance weight or an elastic member in a direction in which the cleaning means is lifted, and abutted against the building board under conveyance to thereby be pushed down, whereby the cleaning means is withdrawn below the painting position, and wherein the support arm is raised by means of the balance weight or the elastic member to thereby lift the cleaning means to a cleaning position after the building board has passed the painting position.

12. A method of painting building boards comprising the steps of:

conveying at least one building board along a roller conveyor to a painting position;

injecting paint from a plurality of injection nozzles which are positioned in a nozzle assembly disposed over the painting position when said building board reaches the painting position, whereby the paint is applied to a surface of said board;

interrupting the injection of paint when said building board has been painted and has passed the painting position;

vertically moving a cleaning means between the conveyor rollers and toward the injection nozzles;

cleaning a lower end of each injection nozzle and portions of the nozzle assembly adjacent to each injection nozzle with the cleaning means during said interruption of injection, so that the paint adherent to the lower end of each injection nozzle and to portions of the nozzle assembly adjacent to each injection nozzle is removed, vertically moving the cleaning means to a position removed from said painting position, resuming said paint injection with a subsequent building board.

* * * * *